US011058263B1

(12) United States Patent
Collins

(10) Patent No.: US 11,058,263 B1
(45) Date of Patent: Jul. 13, 2021

(54) BRISTLED ROPE BATHING TOOL WITH SOAP DISPENSER

(71) Applicant: Walter Collins, Sacramento, CA (US)

(72) Inventor: Walter Collins, Sacramento, CA (US)

( * ) Notice: Subject to any disclaimer, the term of this patent is extended or adjusted under 35 U.S.C. 154(b) by 0 days.

(21) Appl. No.: 17/154,473

(22) Filed: Jan. 21, 2021

(51) Int. Cl.
*A47K 7/02* (2006.01)
*A47K 7/03* (2006.01)

(52) U.S. Cl.
CPC ..... *A47K 7/022* (2013.01); *A47K 7/028* (2013.01); *A47K 7/03* (2013.01)

(58) Field of Classification Search
CPC ..... B05C 17/02–17/0242; A47K 7/022; A47K 7/028; A47K 7/03
See application file for complete search history.

(56) References Cited

U.S. PATENT DOCUMENTS 1,628,023 A 11/1926 Adkins
2,318,680 A 1/1942 Ellinger
2,505,610 A 4/1950 Ellinger
3,720,205 A 3/1973 Liebman
3,936,198 A 2/1976 Martin
5,401,550 A 3/1995 Hannon
6,464,796 B2 * 10/2002 Vail ..... B08B 1/04 134/15
8,387,833 B2 3/2013 LaFlamme
2009/0255080 A1 10/2009 Lozinik
2020/0237165 A1 * 7/2020 Brown ..... A47K 7/03

* cited by examiner

*Primary Examiner* — Shay Karls
(74) *Attorney, Agent, or Firm* — Heisler & Associates

(57) ABSTRACT

A rope is formed of multiple separate strands including at least one soap supply strand, at least one bristle strand and multiple absorbent strands. These strands extend between a proximal end of a distal end of the rope. The bristle strands include bristle bundles extending radially therefrom, preferably concentrated at a central portion of the bristle strands. The soap supply strand has a hollow interior and slits which allow soap to ooze out and be accumulated on the absorbent strands. A liquid soap reservoir is attached to one end of the soap supply strand which can be squeezed to cause soap to ooze out of the slits and be collected upon the absorbent strands. A handle and the liquid soap reservoir at opposing end of the rope allow the bathing tool of elongate flexible form to be maneuvered for scrubbing and washing of skin of a bather.

14 Claims, 3 Drawing Sheets

A
A
40
42
44
46
48
50
52
60
62
30

BRISTLED ROPE BATHING TOOL WITH SOAP DISPENSER

FIELD OF THE INVENTION

The following invention relates to elongate flexible back and skin scrubbing inventions generally in the form of a rope for use in scrubbing various body parts during bathing. More particularly, this invention relates to bathing tools which include a soap dispenser integrated therein as well as bristles and which has an elongated form for use by hand to assist in bathing.

BACKGROUND OF THE INVENTION

Accessories for assisting in the washing and scrubbing of an individual's back, such as while in the shower, are known in the prior art. Examples include scrubbing pads with handles in each end which are about two to three feet long. Some such scrubbing pads emphasize a more coarse surface for exfoliation, while other such scrubbing pads have more of an absorbent character for carrying soapy water and delivering the soapy water to skin that the accessory comes in contact with. The handles at opposite ends of such scrubbing pads can be held by hands of a user to allow for controlling positioning and movement of the accessory relative to the back (or other skin areas) of the individual using the accessory. Such accessories, while generally effective, must first be loaded somehow with soap, such as by scrubbing a bar of soap on a surface of such an accessory, before it can carry the soap to the back of a user.

Accessories are also known for conveniently providing a bar of soap in a bathing area such as a shower, in a way which decreases the likelihood of dropping the soap, such as a "soap on a rope" type product. The elongate "rope" of such a product can be placed around a neck of a user, as it is often a loop of rope, or it can be hung over a shower head or other structure within a shower environment. Such elongate soap carriers generally do not provide a scrubbing or washing function themselves, but merely help in the handling of the soap in an environment such as a shower.

Other known devices and accessories for providing a soap carrying and/or a back scrubbing/washing function, such as within a shower environment, include those disclosed in patents and published patent applications such as: U.S. Pat. Nos. 1,628,023; 2,318,680; 2,505,610; 3,720,205; 3,936,198; 5,401,550; 8,387,833; and U.S. Published Patent Application No. 2009/0255080. Some of these devices have some integration of soap delivery and washing/scrubbing characteristics.

When an individual is bathing, such as in the shower, a general goal for the back of the bathing individual (and other hard to reach skin surfaces, such as feet) is to provide delivery of soap to skin on the back of the individual, and to provide some degree of washing/scrubbing action along with the soap, to clean the skin. As many individuals have difficulty reaching all of the surface area of the skin on the back of the individual, merely utilizing a wash cloth and source of soap, or merely utilizing a bar of soap in a hand of the individual, is often inadequate. Rather, what is needed is an elongated scrubbing/washing device and a convenient methodology for loading soap onto such a device in a manner which can be controlled as to how much soap is placed onto the device, and which can be easily managed once loaded with soap for applying the soap to the skin of the back (and potentially other skin areas) of the individual.

SUMMARY OF THE INVENTION

With this invention, an elongate flexible structure in the nature of a rope is provided with integrated soap delivery therein. This elongate flexible structure has at its core a slitted (or holed or fenestrated) tube extending between ends. In one embodiment, at least one of the ends is fitted with a handle and at least one of the ends is fitted with a liquid soap container. The elongate flexible structure also has scrubbing/washing elements extending therealong. In one embodiment these elements include braided (or otherwise woven or non-woven) water absorbent elongate strands extending longitudinally over a majority of the length of the elongate flexible structure. Preferably bristle strands are also interwoven with the absorbent strands, which bristles extend generally radially from a central axis of the bristle strands. The bristles can have a softer or a harder character, depending on the preferences of the user.

Preferably, at least one end of the tube has an interface thereon, through which the liquid soap container can be removably attached. As an option, each end of the tube could have such an interface. If each end of the tube has such an interface, typically one of these interfaces is merely capped in a removable fashion. The liquid soap container has a complementary formed interface so that it can be removably attached to one of the ends of the tube. As one example, the interface could be a threaded interface with each end of the tube having male threads thereon and with a cap and a mouth on a tip of a liquid soap container having a correspondingly formed female threaded connector. In this way, the liquid soap container and/or a cap can be removably attached to the ends of the tube.

By having each of the ends be openable by disconnecting each of these interfaces from caps/bottles, cleaning of the tube and the elongate flexible structure can more completely be facilitated. As an example, hot fresh water could be run through the tube from end to end, to dissolve and remove soap therefrom periodically. Hot water could also be placed within an empty flexible container, so that hot water can be squeezed out of the slits in the tube by squeezing the container, and further completing the periodic cleaning process. The elongate elements and bristles can be washed in a more traditional fashion, such as by running through the laundry, or soaking in hot water, such as in a laundry sink, or utilizing other known methods, depending on the materials particularly involved in forming the elongate elements and/or bristles.

In one embodiment, the cap at one of the interfaces also has a handle structure attached thereto (or nearby), so that the handle at an end of the elongate flexible structure is removably attachable through the cap (or otherwise). As another alternative, the handle could be attached to the elongate absorbent strands or other portions of the overall assembly. In one form, the handle has two lanyards on either end of a rigid transverse grip element. In another embodiment, the handle is merely a loop of rope, fabric or other flexible structure which can be readily gripped by a hand of an individual. As an option, a handle could be provided at each end of the elongate flexible structure, with one of the handles either integrated into the liquid soap dispenser or merely being attached to the liquid soap dispenser or to elongate elements (or the tube) at an end of the elongate flexible structure near where the liquid soap dispenser is connected to the tube. The handles allow for holding of the ends of the elongate flexible structure and for positioning and motion of the elongate flexible structure during use. The liquid soap container can act as a handle as well, in one form having a size/shape which facilitates gripping with a hand.

The tube preferably has a length similar to an overall length of the elongate flexible structure. The tube could be formed of a flexible polymeric hydrocarbon material such as materials from which flexible water carrying tubing is often made, or from which drip irrigation tubing is made, or similar to how hoses of various types are formed. As one example, the tube could be in the form of what is commonly referred to as "surgical tubing." While surgical tubing is typically stretchable in a longitudinal direction, most preferably the tube is flexible laterally so that it can be readily bent, but has only a minimal degree of longitudinal elasticity, so that a length of the elongate flexible structure is relatively static and a volume of an interior of the tube is generally constant.

The slits in the tube are most preferably elongate slits which are provided periodically along the tube. As an example, if the tube has a ¼ inch diameter and is 2 feet long, ½ inch long slits might be provided every inch along a length of the tube. The slits could be provided along a single pathway extending between the ends, or multiple pathways of slits could be provided extending between the ends, such as two pathways of slits with each pathway of slits circumferentially spaced from each other by approximately 180°. As many as four (or more) pathways of slits (or other holes) could be provided as an option.

In one embodiment, the slits are replaced with holes of a more circular (or other) shape. Such holes would be provided along at least a portion of the length of the tube between the ends. In one embodiment, the slits/holes are concentrated near a middle half of the elongate flexible structure, so that soap dispensing out of the slits is concentrated at a middle of the elongate flexible structure. This can help to avoid the handle and soap dispensing container becoming slippery with soap, as soap would be concentrated at a mid location most distant from the handle and soap dispenser.

The slits and/or holes are preferably sufficiently small that soap/soapy water does not migrate from an interior of the tube to outside of the tube unless some differential pressure is provided between an interior of the tube and the exterior of the tube. For instance, the user squeezing the soap dispenser would provide such an increased internal pressure which would then cause liquid soap to migrate through the slits/holes to an exterior of the tube. The liquid soap then typically comes in contact with wet surfaces of the elongate elements and/or bristles, so that these elongate elements and/or bristles would take on a soapy character and be ready for delivery of soap to the back of the individual or other skin areas.

When initially using the elongate flexible structure of this invention, an interior of the tube is typically empty. It is desirable that the liquid soap holding container fill an interior of the tube, but still have its exterior walls largely undeformed. This function benefits from various techniques for managing fluids within an interior of the tube and the liquid soap container. As one option, the liquid soap container could be connected to one end of the tube and the cap could be removed. The liquid soap container could be squeezed until the tube is full of soap. The cap would then be replaced on the end of the tube opposite the liquid soap container and the tube would then be full.

The liquid soap container could then be removed from the tube and be filled to top off the liquid soap container so that it is totally full. The liquid soap container would then be attached to the tube again. The elongate flexible structure would then be ready for use, being full of liquid soap within the tube and full of liquid soap within the liquid soap container. Squeezing of the liquid soap container, just a little bit, would cause soap to be dispensed from the tube through the slits, immediately before and during use of the elongate flexible rope structure of this invention.

The liquid soap container is shown in one embodiment as being a hollow generally orthorhombic structure which is sized to fit within a hand of an individual and to be easily held and carried. Two opposing sides of this container preferably define approximately half or more of an outer surface area of the liquid soap container. These largest walls of the liquid soap container are preferably sufficiently flexible that one can readily push these large surfaces toward each other to increase interior pressure and cause liquid soap to be pushed out of the slits/holes in the tube. To provide such flexibility, the liquid soap container could be formed of a polymeric hydrocarbon material, such as some form of plastic from which containers such as shampoo bottles and liquid soap bottles are often formed. A variety of alternative container types and shapes could be provided in various different embodiments.

In at least one embodiment, some form of more controlled soap advancement could be utilized, such as with a liquid soap container having some form of pump device thereon which pump can be manually actuated to cause a "dose" of soap to be advanced with each toggling of such a pump structure. A container with such a pump element could be sufficiently flexible to allow for complete emptying of the container, or could have some relief valve to allow ullage to fill the container as it is emptied of soap. A bladder within the container could keep soap away from ullage (such as water or air) so that all of the soap can be dispensed from the container in an efficient manner.

The liquid soap container could be provided as a cartridge which could be purchased full of soap, attached to the interface on the elongate flexible structure and then utilized thereon. The user would periodically purchase new cartridges of liquid soap so that once one cartridge has been depleted of soap, a new cartridge would be attached and the old cartridge disposed of (or refilled or repurposed).

OBJECTS OF THE INVENTION

Accordingly, a primary object of the present invention is to provide a bathing tool which assists in cleaning of various different parts of the body.

Another object of the present invention is to provide a bathing tool which has both a wash cloth aspect and a bristled scrubbing aspect.

Another object of the present invention is to provide a bathing tool which is elongate in form and which can be handled on at least one end thereof, and typically both ends thereof, for both washing and scrubbing.

Another object of the present invention is to provide a bathing tool which can provide a scrubbing function and also has soap integrated therein to assist in applying soap to the tool.

Another object of the present invention is to provide a method for manufacturing an elongate bathing tool which is relatively easy to perform and to produce a consistent strong product with bristles thereon for scrubbing.

Another object of the present invention is to provide a method for washing skin using a rope with soap reservoir integrated therein, to simplify bathing.

Another object of the present invention is to provide an elongated bathing tool in the form of a rope which includes a core which delivers soap from a liquid soap reservoir and dispenses the soap from the core outward to soft absorbent structures forming at least a portion of the rope, for delivery of soap to the body of a bather during use.

Other further objects of the present invention will become apparent from a careful reading of the included drawing figures, the claims and detailed description of the invention.

DESCRIPTION OF THE PREFERRED EMBODIMENT

Figures 1, 2, 3, 4:
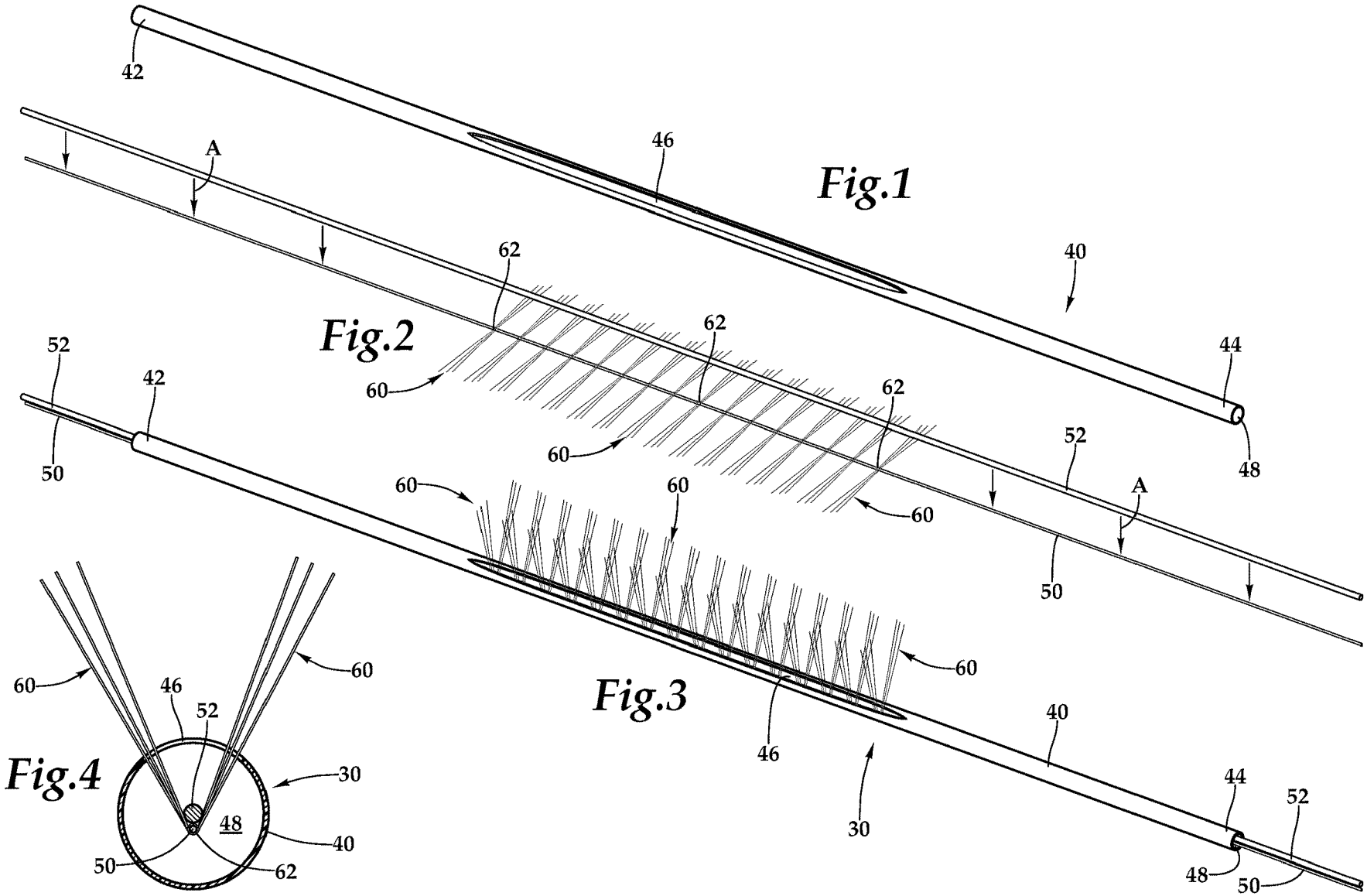
FIG. 1 is a perspective view of a slotted tube which forms a portion of a bristled strand of a rope within a bathing tool, according to one embodiment of this invention.
FIG. 2 is a perspective view of a flexible line and wire in the process of having bristle bundles attached thereto before combination with the slotted tube of FIG. 1.
FIG. 3 is a perspective view of a completed bristled strand including the slotted tube of FIG. 1 and the flexible line and stiffener wire and bristle bundles of FIG. 2, all incorporated together.
FIG. 4 is an end elevation view of a central portion of that which is shown in FIG. 3.

Referring to the drawings, wherein like reference numerals represent like parts throughout the various drawing figures, reference numeral 10 (FIG. 7) is directed to a bathing tool having an elongate form including a rope 20 extending between a handle 25 at a distal end 24 and a liquid soap dispensing reservoir 80 at a proximal end 22, which feeds liquid soap into a soap supply strand 70 within a core of the rope 20 of the bathing tool 10. Bristle strands 30 are woven into the rope 20 of the bathing tool 10, along with absorbent strands 90 to complete the bathing tool 10 (FIG. 8).

Figure 8:
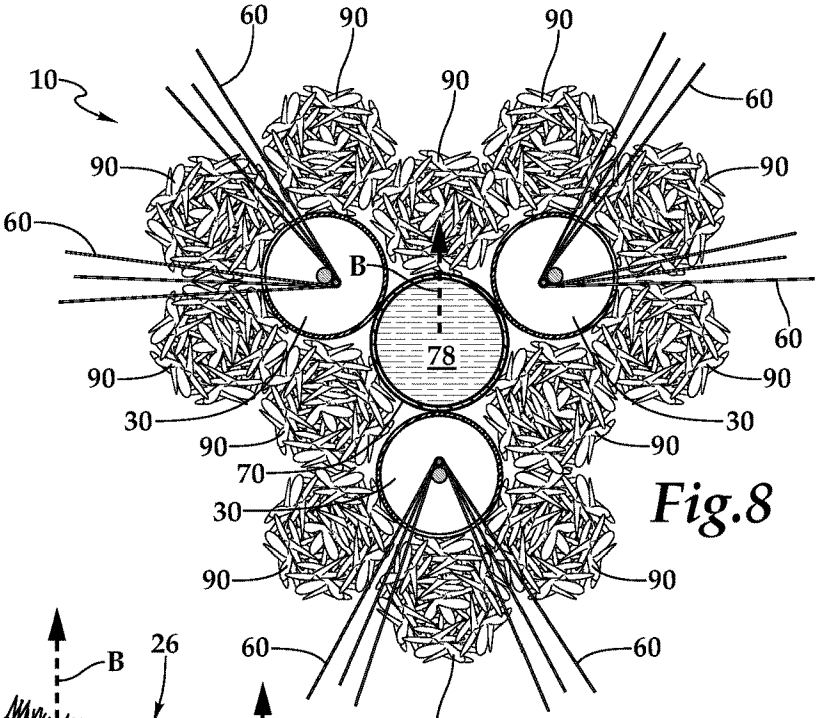
FIG. 8 is a full sectional end elevation view of that which is shown in FIG. 7, taken on a central portion thereof, and which includes bristles radiating from a rope portion thereof, according to one embodiment of this invention.
Figure 7:
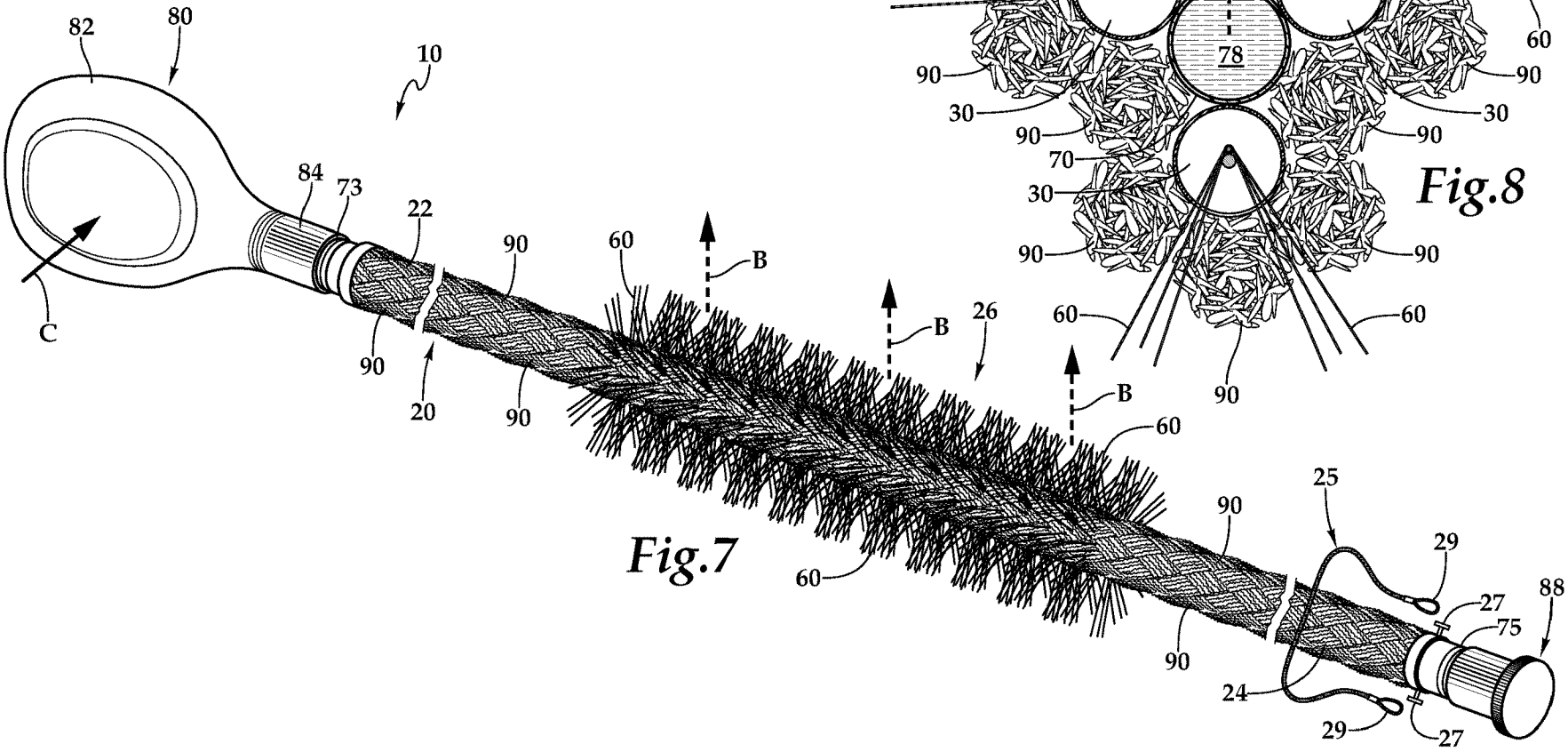
FIG. 7 is a perspective view of the bathing tool of this invention in completed form and ready for use, according to one embodiment.

In essence, and with particular reference to FIGS. 7 and 8, basic details of the bathing tool 10 of this invention are described, according to one example embodiment. The bathing tool 10 is largely comprised of an elongate flexible rope 20 formed of multiple separate strands. In this example embodiment three bristle strands 30 are provided as part of the rope 20. The bristle strands 30 in this example embodiment include a slotted tube 40 with a centrally located large slot 46 extending longitudinally therein, and through which bristle bundles 60 extend radially outward from the bristle strands 30. A flexible line 50 and stiffener wire 52 are coupled to these bristle bundles 60, with the flexible line 50 and stiffener wire 52 passed longitudinally through an interior 46 of the slotted tube 40 to position the bristle bundles 60 adjacent to the slot 46 in the slotted tube 40, so that these bristle bundles 60 can radiate out of the slot 46 and radially from an elongate central axis of each slotted tube 40.

A soap supply strand 70 extends along a core of the rope 20 in this example embodiment. The soap supply strand 70 includes multiple slits 76 therein which allow liquid soap to pass from an interior 78 and soak into outward portions of the rope 20 of the bathing tool 10. A liquid soap reservoir 80 and a cap 88 are attached to opposing ends of the liquid soap strand 70. Squeezing of the liquid soap reservoir 80 causes liquid soap to ooze from the slits 76 of the soap supply strand 70. Absorbent strands 90 are also incorporated into the rope 20 of the bathing tool 10, with twelve absorbent strands 90 provided in this example embodiment, and completing the rope 20 as well as providing a soft absorbent structure on an exterior of the rope 20, to assist in soap delivery and washing function.

More specifically, and with continuing reference to FIGS. 7 and 8, structural details of the rope 20 are described, according to this example embodiment. The rope 20 is elongate in form extending between a proximal end 22 and a distal end 24, defining opposing ends of the rope 20 making up the flexible structure of this invention. The rope 20 includes a central region 26 providing about a third of an overall length of the rope 20 and spaced from both the proximal end 24 and distal end 24. The central region 26 is provided with the bristle bundles 60 as well as the slits 76 in the soap supply strand 70, in this example embodiment.

A handle 25 is preferably provided near a distal end 24 of the rope 20. The handle 25 can be attached through horns 27 and with loops 29 on ends of the handle 25. The handle 25 in this example is an elongate length of flexible material which is sufficiently long to have slack therein and so that it can be readily gripped by a hand of a user for handling one end of the rope 20 of the bathing tool 10. The liquid soap reservoir 80 adjacent to the proximal end 22 of the bathing tool 10 has a hand grippable size so that the liquid soap reservoir 80 can be held by one hand of a bather while the handle 25 is held by a second hand of the bather, for wielding of the bathing tool 10 in a variety of different ways.

For instance, the bathing tool 10 can have a portion thereof passed under a foot of a user, and the user can alternatively pull with opposite hands to move the rope 20 of the bathing tool 10 back-and-forth to wash undersides of feet of the bather. Similarly, the rope 20 of the bathing tool 10 can be passed around a back of a user while the soap reservoir 80 and handle 25 are held by opposing hands of a user, and with alternating force applied between hands of the bather, the rope 20 of the bathing tool 10 can move back-and-forth to scrub a back of a bather. Absorbent strands 90 soak up liquid soap, as well as water from a tub or shower to provide soft presentation of soap and soft scrubbing action (similar to that of a wash cloth) to deliver soap to various different parts of a body of the bather.

The horns 27 are preferably rigid and radiate from opposite sides of the rope 20 near the distal end 24, such as by integration into the second end 24 of the soap supply strand 70 adjacent to where the cap 88 is attached to this second end 74. As an alternative, the horns 27 could be fitted to the cap 88 itself. The horns 27 preferably have knobs at tips thereof with the loops 29 at the end of the handle 25 just slightly larger than these knobs at the end of the horns 27, so that the loops 29 can be fitted over the knobs on the ends of the horns to securely but removably attach the loops 25 at the end of the handle 25 to the horns 27. The spacing between the horns 27 is about one inch in one embodiment. The handle 25 is longer than the spacing between the horns 27, so that sufficient slack is provided that fingers of a hand of a bather can fit around the handle 25 for securely holding the handle 25 during wielding of the bathing tool 10.

With particular reference to FIGS. 1-4, details of the bristle strands 30 of the rope 20 are described, according to the example embodiment disclosed herein. The bristle strands 30 are preferably made up of four separate parts, including a slotted tube 40, a flexible line 50, a stiffener wire 52 and multiple bristle bundles 60. One of the flexible line 50 or the stiffener wire 52 could conceivably be eliminated, or incorporated together into a single item.

The slotted tube 40 is an elongate flexible tube with a hollow interior 48 extending between a first end 42 opposite a second end 44. An elongate slot 46 extends longitudinally and extending in an axial direction between the first end 42 and second end 44. The slot 46 has a length which in this example is about ⅓ as long as the length of the slotted tube 40. The slot 46 is centered between the first end 42 and second end 44 in this example embodiment. The slot 46 of the slotted tube 40 is provided to allow the bristle bundles 60 to extend out of the slotted tube 40 of each bristle strand 30.

The slotted tube 40 is preferably formed of flexible resilient long chain polymeric hydrocarbon plastic material, such as polyethylene, nylon, or other suitable hydrocarbon material, which is preferably sufficiently strong and flexible to withstand forces associated with tension applied by hands of a bather and which is easily cleaned and generally smooth on an exterior surface thereof. In one embodiment, slotted tube 40 is ⅛ inch in diameter, but it could have a variety of different dimensions. In one embodiment, the rope 20, and the bristle strands 30 are six feet long, with a central region 26 of the rope 20 being about two feet long.

While the slot 46 could spiral along a length of the slotted tube 40, most preferably, the slot 46 is linear in form, so that the bristle bundles 60 radiating from each bristle strand 30 are generally oriented along a line, unless the bristles strands 30 are twisted somewhat, in which case the bristle bundle 60 will take on a helical form after such twisting of the bristle strands 30. Only a small amount of twisting would be required in a typical embodiment, such as so that ends of the slot 46 on the slotted tube 40 might be displaced 360° from each other circumferentially with the slot 46 thus forming one helical turn, as one option.

The flexible line 50 is in the form of fishing line in one embodiment, such as in the form of 100 pound test fishing line. According to one method, during manufacture of the bristles strands 30, the flexible line 50 is laid out flat on an underlying surface in a linear fashion. Multiple bristle bundles 60 are then placed adjacent to this flexible line 50 (see FIG. 2). Optionally but preferably, a stiffener wire 52 is placed down onto the flexible line 50 (along arrow A of FIG. 2). The stiffener wire 52 can help to hold the bristle bundles 60 to the flexible line 50. Also, the stiffener wire 52 causes the overall rope 20 to have somewhat of a character where it can be bent and hold at least somewhat the bent shape into which it is bent. The wire 52 is preferably provided from an alloy of steel which is generally compatible with the moist environment of a shower, such as being stainless steel. In one embodiment, the wire is 28 gauge, capable of being bent multiple times without exceeding its elastic limit and breaking.

The bristle bundles 60 are preferably each about four inches long between ends of the bristles within the bristle bundles 60. A midpoint 62 of the bristle bundles 60 is preferably adjacent to the flexible line 50. The bristle bundles 60 are attached to the flexible line 50. Such attachment can occur through utilization of an adhesive which is compatible with the materials from which the flexible line 50 and bristle bundles 60 are formed. The bristle bundles 60 could be formed of boars hair, plastic, nylon, horse hair, or any other suitable bristle material. While FIG. 2 shows each bundle of bristles 60 having three bristles therein so that the individual bristles can be seen, typically each bristle bundle 60 would have a larger number of bristles thereon, such as typically one or two dozen bristles.

Attachment of the bristle bundles 60 to the flexible line 50 could alternatively or in addition occur through tying of knots between the flexible line 50 and the bristle bundles 60. As a further option, multiple flexible lines 50 could be provided in parallel with each other, some above the bristle bundles 60 and some below the bristle bundles 60. The flexible lines 50 could then be bonded together, such as with an adhesive, or by heat welding, or by sonic welding, or by some other heating and/or bonding methodology to bond to flexible lines 50 together and which entraps midpoint 62 of the bristle bundles 60 within the matrix formed by the flexible lines 50. As a further option (or in addition), multiple such flexible lines 50 could be woven together tightly to entrap the bristle bundles 60 within this weave of multiple flexible lines 50. While bonding of the bristle bundles 60 is describe relative to the flexible line 50, such attachment could alternatively occur between the bristle bundles 60 and the stiffener wire 52. The stiffener wire 52 could replace the flexible line 50 or can be provided along with a flexible line 50.

To manufacture the bristle strands 30, after the flexible end 50 has had the bristle bundles 60 securely attached thereto, one end of the flexible line 50 and stiffener 52 is passed into the first end 42 of the slotted tube 40. Translation of the flexible line 50 through the interior 48 of the slotted tube 40 continues, aided at least partially by the partial rigidity of the stiffener wire 52, until the flexible line 50 reaches at least the beginning of the slot 46 in the slotted tube 40. The flexible line 50 can then be gripped and pulled (as well as pushed) along a length of the slot 46 in the slotted tube 40, and then this end of the flexible line 50 can be fed into this slotted tube 40 at the end of the slot 46 and fed down to the second end 44, by advancing through gripping of the flexible end 50 and stiffener 42 through the slot 46 to further advance the flexible line 50 and stiffener wire 52 longitudinally, until it extends out of the second end 44 of the slotted tube 40.

Preferably the flexible line 50 is slightly longer than the slotted tube 50 (ends of FIG. 3), so that the flexible end 50 can be pulled out of the second end 44 somewhat, for centering of the bristle bundles 60 adjacent to the slot 46. Furthermore, the stiffener wire 52 is preferably slightly longer than this flexible line 50 so the end of the stiffener 52 can also be gripped adjacent to the first end 42 and second end 44 of the slotted tube 40. The flexible line 50 can then be worked back-and-forth and the bristle bundles 60 can be encouraged to have both of the bristle tips protrude out of the slot 46 in the slotted tube 40.

The ends 42, 44 the slotted tube 40 can be pushed toward each other slightly to open the slot 46 extra, to further encourage escape of the bristle bundles 60 out of the slot 46. If needed, a tool can be utilized, such as an elongated probe, to reach under the bristle bundles 60 and encourage the bristle tips to pass out of the slot 46 in the slotted tube 40. After all of the bristle bundles 60 have their bristle tips extend out of the slot 46 in the slotted tube 40, the ends 42, 44 can be tensioned to close the slot 46 and cause the bristle bundles 60 to extend generally in a somewhat common radial direction, perhaps angled away from each other by 90° or less (or in other embodiments 120° or less, or another embodiment 45° or less, as shown in FIG. 4). This causes both tips of the bristles in bristle bundles 60 to radiate from the bristle strand 30 to which they are a part, in a somewhat common direction (see FIG. 8).

By utilizing three bristle strands 30 in this example embodiment, and with the bristle bundles 60 and bristle strands 30 extending in different radial directions, the bristle bundles 60 can have their tips radiate in substantially all directions away from the rope 20 of the bathing tool 10. The bristle strands 30 can then be rotated somewhat together, so that a helical spiral occurs in the pathways the bristle bundles 60 follow as they radiate away from the rope 20, if desired. As a further alternative, the bristle strands 30 could optionally be braided together or otherwise woven together, both with each other, and optionally also with the supply strand 70, and also the absorbent strand 90.

Figures 5, 6:
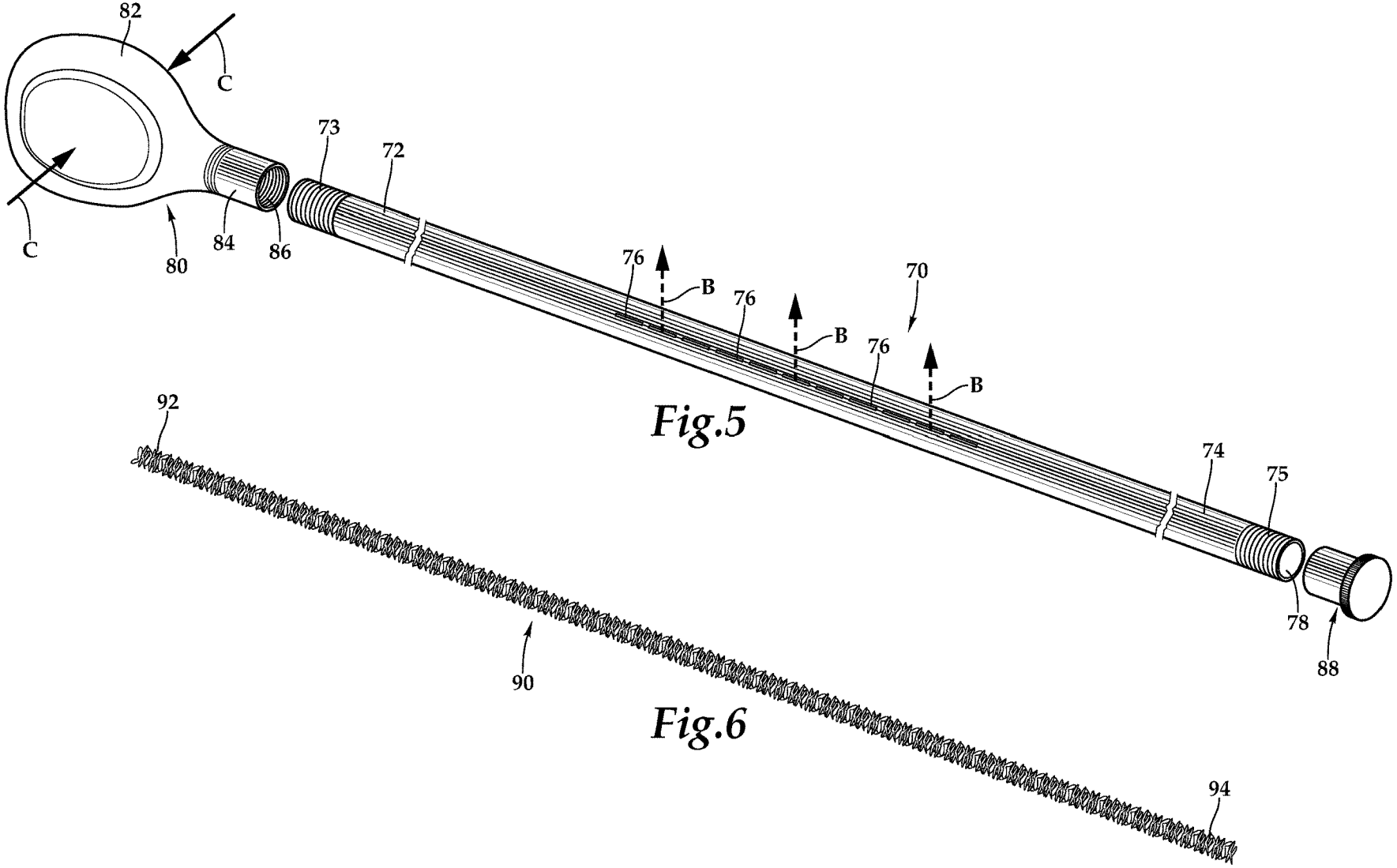
FIG. 5 is a perspective view of a soap supply strand for placement within a core of the rope of the bathing tool, according to one embodiment of this invention.
FIG. 6 is a perspective view of a single absorbent strand which is provided along with other typically similar strands and the soap supply strand and bristle strands, to form the rope of the bathing tool, according to one embodiment of this invention.

With particular reference to FIG. 5, details of the soap supply strand 70 are described, according to this example embodiment. The soap supply strand 70 is provided to deliver soap in liquid form from the liquid soap reservoir 80 through the soap supply strand 70 and out of slits 76 (or other holes) concentrated along a central portion of the soap supply strand 70 (in this example), and for soaking up of sudsy water by the absorbent strands 90 of the rope 20 of the bathing tool 10, for delivery of soap to a body of the bather.

The soap supply strand 70 includes a first end 72 opposite a second end 74. These ends 72, 74 are preferably spaced apart similar to the length of the slotted tube 40. The slits 76 are preferably concentrated along a central third of the soap supply strand 70. An interior 78 of the soap supply strand 70 is hollow extending between the ends 72, 74. The ends 72, 74 preferably are fitted with threads 73, 75 (or other attachment details) to allow for removable attachment of the liquid soap reservoir 80 to the first end 72 and a cap 88 to the second end 74. Such removable attachment of the liquid soap reservoir 80 and cap 88 allow for thorough washing of an interior 78 of the soap supply strand 70 and pre-loading before use. While the threads 73, 75 are shown as male threads on the exterior of the ends 72, 74 they could alternatively be female threads if the liquid soap reservoir 80 and cap 88 are threaded in an alternative fashion to be complementary with threads at the ends 72, 74.

While the soap supply strand 70 is shown as having a constant cross-sectional form, in one embodiment the ends 72, 74 are larger in diameter, matching a diameter for the overall rope 20, with inboard portions of the supply strand 70 extending between the ends 72, 74 having a smaller diameter similar to that depicted in FIG. 8 and similar to a diameter of the bristle strands 30, such as perhaps ⅛ inch in diameter (and hence similar smaller cross-sectional area and volume) of the supply strand 70, so that most of the soap resides within the liquid reservoir 80, rather than being contained within the interior 78 of the soap supply strand 70.

In one embodiment, the soap supply strand 70 is formed of a similar material and with similar geometry to that of the bristle strands 30, such as formed of a polymeric long chain hydrocarbon material such as polyethylene or nylon. The slits 76 are preferably sized sufficiently small so that soap does not escape from the interior 78 of the soap supply strand 70 (along arrow B of FIGS. 5, 7 and 8), unless soap within the interior 78 is pressurized somewhat to create a differential pressure between the interior 78 of the soap supply strand 70 and an exterior atmosphere. In this manner, soap is discouraged from leaking out of the slits 76, but only oozes out of the slits 76 when encouraged to do so by squeezing of the liquid soap reservoir 80.

The liquid soap reservoir 80 is preferably a hollow vessel of approximately hand grip size, such as having dimensions of two to four inches in width and thickness, and with a slightly greater dimension in length extending axially away from the rope 20. This liquid soap reservoir 80 includes a thin walled body 82 surrounding an interior which contains soap therein. A tip 84 of the reservoir 80 is smaller than other portions of the body 82, and sized similar to the first end 72 of the soap supply strand 70. The tip 84 has female threads 86 which can thread onto the threads 73 on the first end 72 of the soap supply strand 70, to facilitate removable attachment of the liquid soap reservoir 80 onto the soap supply strand 70. In this manner, the liquid soap reservoir 80 can be refilled with liquid soap (or replaced with new full cartridges of liquid soap) when a first cartridge of liquid soap in the form of a liquid soap reservoir 80 is emptied of soap.

A user squeezes the body 82 (along arrow C of FIGS. 5 and 7) to pressurize contents of the body 82 of the reservoir 80. This pressurization as well as decrease in volume causes liquid soap to pass out of the body 82 of the reservoir 80 and pass along the interior 78 of the soap supply strand 70. This differential pressure causes the soap to migrate through the slits 76 (along arrow B) to an exterior of the soap supply strand 70. This soap then comes into contact with the absorbent strands 90 so that the absorbent strands 90 soak up the liquid soap and water to create a sudsy liquid suitable for washing purposes.

With particular reference to FIG. 6, details of the absorbent strands 90 are described, according to this example embodiment. Each absorbent strand 90 extends from the first end 92 to a second end 94. Preferably this length between the ends 92, 94 is similar to the length of the bristle strands 30 and soap supply strand 70. The absorbent strands 90 are formed of a material which has soft absorbent characteristics. As one option, absorbent strands 90 could be formed of cotton, and could have a similar character to that of strands on a typical cotton mop head. As another option, the absorbent strands 90 could be formed of a soft "terry cloth" type material, or a woven rug type material, or other suitable material which has water absorbent characteristics, and which has a desirable texture, which could match materials and textures provided for various different forms of washcloths and other washing tools. In this example embodiment, twelve absorbent strands 90 are provided. One objective of the absorbent strands 90 is to completely cover the soap supply strand 70 and bristle strands 30, so that the rope 20 of the bathing tool 10 only has an exterior with visible presence of absorbent strands 90 or the bristle bundles 60, and which can come into contact with the skin of the bather.

To completely cover the bristle strands 30 (but not the bristles) and the soap supply strand 70, and to provide the rope 20 with additional strength and a uniform appearance, the absorbent strands 90 can be woven together in some weaving fashion, or can be twisted together, or can be braided together, or can be sewn together with stitching, such as with thread. Ends of the absorbent strands 90 are preferably bonded either to each other, or to the soap supply strands 70, such as at the first end 72 and second end 74, or to the ends 42, 44 of the slotted tube 40, or attached (such as with a fastener and/or adhesive) to some intermediate junction structure which holds all of the absorbent strands 90, and also optionally the soap supply strand 70 and bristle strands 30 uniformly together at the ends thereof. As an alternative, ends of the absorbent strands 90 could be tied off together such as in a knot or knots to prevent unweaving thereof.

With such orientation of the absorbent strands 90 along a radial exterior of the rope 20 of the bathing tool 10, a finished form of the bathing tool 10 is similar to that depicted in FIG. 7 and having a cross-section similar to that depicted in FIG. 8, in this example embodiment. As will be seen, a variety of different embodiments could be provided with different numbers of bristle strands 30, soap supplies strands 70 and absorbent strands 90, to form the rope 20 in various different alternative bathing tools 10 within the scope of this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. An elongate flexible structure for assisting in washing skin, comprising combination:

a tube extending between a first end and a second end, said tube having a hollow interior therein;

at least one of said ends of said tube including an interface thereon;

a liquid soap container coupled to said tube through said interface;

said tube including a plurality of holes passing between an interior of said tube to an exterior of said tube;

at least one absorbent element adjacent to an exterior of said tube and adjacent to at least one of said plurality of holes;

wherein said absorbent element includes a plurality of elongate absorbent strands extending at least partially between said ends of said tube;

wherein said elongate absorbent strands surround a majority of an exterior of said tube; and wherein a plurality of bristle strands extend parallel with said tube, said bristle strands including bristles which extend radially relative to said tube and said elongate absorbent strands.

2. The structure of claim 1 wherein said plurality of holes include a plurality of slits between said ends.

3. The structure of claim 1 wherein said plurality of holes are concentrated closer to a midpoint of said tube then to said ends.

4. The structure of claim 1 wherein said interface is a removable interface between said tube and said liquid soap container.

5. The structure of claim 4 wherein said interface is threaded with complemental threads located upon said end of said tube and upon said liquid soap container.

6. The structure of claim 5 wherein said liquid soap container has flexible sidewalls.

7. The structure of claim 1 wherein each of said ends has an interface thereon.

8. The structure of claim 7 wherein a cap is removably connected to one of said ends through one of said interfaces and said liquid soap container is removably connected to one of said ends opposite said cap.

9. The structure of claim 1 wherein a handle is coupled to at least one of said ends opposite said liquid soap container.

10. A method for washing skin of an individual, including the steps of:

placing an elongate flexible rope adjacent to the back of the individual, the elongate flexible structure including a tube extending between a first end and a second end, the tube having a hollow interior therein, at least one of the ends of the tube including an interface thereon, a liquid soap container coupled to the tube through the interface, the tube including a plurality of holes passing between an interior of the tube to an exterior of the tube, and at least one absorbent element adjacent to an exterior of the tube and adjacent to at least one of the plurality of holes;

moving the elongate flexible structure against the skin of the individual;

squeezing the liquid soap container to cause liquid soap to migrate through the plurality of holes; and wherein said placing step includes the rope having a plurality of bristle strands with bristles extending radially therefrom, and said absorbent element including a plurality of elongate absorbent strands.

11. A bristled bathing rope, comprising in combination:

at least one bristle strand of elongate flexible form extending between a proximal end of the rope and a distal end of the rope;

a plurality of elongate flexible absorbent strands extending between said proximal ends of the rope and said distal end of the rope;

a soap supply strand extending between said proximal end of said rope and said distal end of said rope; and wherein said bristle strands each include a flexible tube with a fishing line therein, each having bristles coupled to said fishing line, said bristle strands each having slots through which said bristles extend.

12. The rope of claim 11 wherein said soap supply strand includes a hollow tube extending between a first end and a second end, with a liquid soap reservoir coupled to at least one of said ends of said hollow tube, said tube including a plurality of holes thereon for liquid soap discharge.

13. The rope of claim 12 wherein said holes are configured as slits.

14. The rope of claim 11 wherein a wire is provided adjacent to said fishing line within each said tube.

* * * * *